United States Patent [19]

Binggeli

[11] Patent Number: 4,538,334

[45] Date of Patent: Sep. 3, 1985

[54] SEAM FOLDING MACHINE

[75] Inventor: Rudolf Binggeli, Meisterschwanden, Switzerland

[73] Assignee: Emil Suter Maschinenfabrik AG, Seon, Switzerland

[21] Appl. No.: 534,068

[22] Filed: Sep. 20, 1983

[30] Foreign Application Priority Data

Sep. 21, 1982 [CH] Switzerland ..... 5573/82

[51] Int. Cl.[3] ..... B23P 11/00

[52] U.S. Cl. ..... 29/243.5

[58] Field of Search ..... 29/243.5, 243.52, 243.58; 493/444, 443, 454; 72/178, 50, 52

[56] References Cited

U.S. PATENT DOCUMENTS

| | | | |
|---|---|---|---|
| 3,015,293 | 1/1962 | Parham | 72/178 |
| 3,067,709 | 12/1962 | Conti et al. | 29/243.52 |
| 3,914,971 | 10/1975 | Colbath | 72/178 |
| 4,006,520 | 2/1977 | Wachter | 29/243.52 |
| 4,080,697 | 3/1978 | Vetrov et al. | 29/243.58 |

FOREIGN PATENT DOCUMENTS

| | | |
|---|---|---|
| 2447037 | 10/1977 | Fed. Rep. of Germany . |
| 1180480 | 6/1959 | France . |

OTHER PUBLICATIONS

"Verbinden von Blech durch Falzen", Fertigungstechnik, 3 Jg., vols. 11 and 12, pp. 447–449 and 507–511, Nov. and Dec. 1953.

*Primary Examiner*—James L. Jones, Jr.

*Attorney, Agent, or Firm*—Murray, Whisenhunt and Ferguson

[57] ABSTRACT

A jointing machine for the folding of seams in manufacturing of seamed metal sheets made of segments of metal sheets is disclosed, wherein the machine includes a locking wheel pivotably positioned in a recess of a resiliently disposed locking wheel carriage. The seam during formation is supported from below by a support roller, and is held from the sides by an adjustment roller together with the locking wheel. The locking wheel carriage is positioned diagonally relative to the surface of the support roller, which enables the machine to manufacture folded seams in very small metal sheet segments, and to utilize thick or hard metal sheets. The particular arrangement of the jointing machine of the present invention which respect to the locking wheel carriage diagonal positioning enables the locking wheel to penetrate even restricted spaces, and the folding of the seam can be accomplished in several steps wherein the use of the locking wheel carriage ensures the transmission to the seam of sufficient force to form a strong folded joint.

9 Claims, 3 Drawing Figures

SEAM FOLDING MACHINE

FIELD OF THE INVENTION

Figure 1:
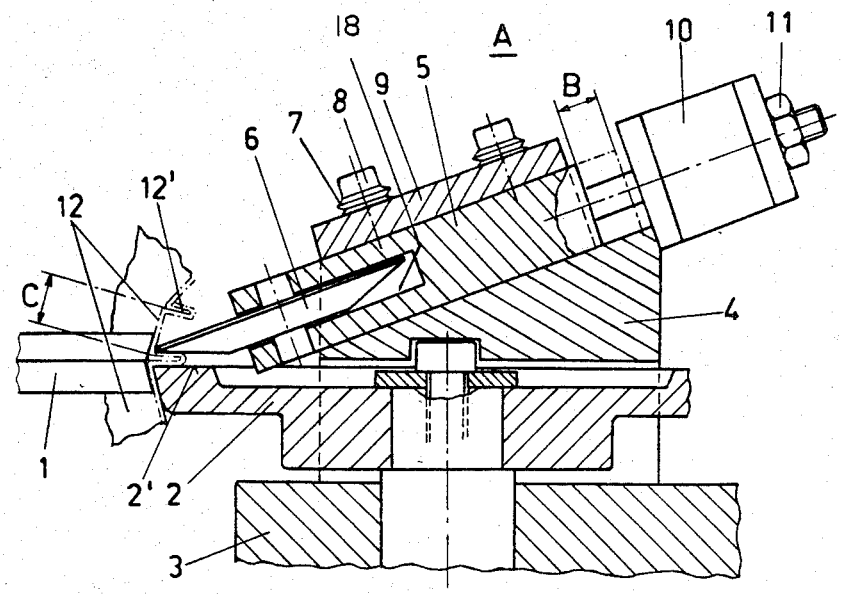

The present invention relates to jointing machines for the closing of folded seams in the manufacture of seamed sheet metal and similar products, wherein a plurality of segments of metal sheets are joined together. The machine includes an adjustment roller, a support roller, and a locking wheel.

BACKGROUND OF THE INVENTION

Jointing machines including an adjustment roller, a support roller and a locking wheel are known in the art. A description of various modifications of such jointing machines is contained in the article "Verbinden von Blech durch Falzen", pp. 447–449 and 507–511 in the trade magazine "Fertigungstechnik" 3. Jg., Vols. 11 and 12, Nov. and Dec. 1953, East Berlin. A specific embodiment of such jointing machines is shown in FIG. 29a on page 508 of the above article. This specific embodiment, however, has the disadvantage of being suitable only for joining large relatively thin metal sheet segments, as it is very difficult for the described apparatus to handle thicker metal sheet segments.

SUMMARY OF THE INVENTION

The present invention provides a solution to the problem of creating a jointing machine according to the prior art mentioned above but having an ability to process smaller and thicker metal sheet segments. According to the present invention, a locking wheel is pivotably positioned in a locking wheel carriage, and the carriage and the adjacent surface of a support roller form an acute angle. This particular arrangement of the present invention is such that the locking wheel is operable even in a very limited space, and the carriage, located in a carriage guide, can apply sufficient pressure to the metal so as to be able to manufacture folded seams in sheets of relatively thick metal sheet segments.

It is decidedly preferred that the locking wheel carriage be resiliently positioned in a support, as this permits the seams to be folded even if uneven thicknesses of the metal sheets is encountered, e.g. in the processing of sheets having other seams therein. In such a case, the locking wheel carriage simply evades or overrides the seams by upward movement.

In one embodiment, the locking wheel carriage is held in the carriage support by means of a guiding plate, with the plate under compression caused by pressure springs, preferably cup springs. This particular embodiment provides a simple yet sufficiently strong mounting of the locking wheel carriage.

The acute angle between the locking wheel carriage and the surface of the support roller is about 20°–30°. The folded seam is formed between these two elements, with the back of the seam being restrained by the adjustment roller. The aforesaid acute angle enables the locking wheel to penetrate into limite spaces, and at the same time apply sufficient pressure at a particular point of the metal sheet which is especially advantageous in the manufacture of sheets from relatively small metal sheet segments.

It is greatly preferred that the locking wheel carriage be adjustable through a mechanical connection to a hydraulic cylinder. This arrangement will supply sufficient force for adjustment of the locking wheel mounted in the locking wheel carriage to close the folded seam. In line with this adjustable control, the cylinder can be adjusted in one or a plurality of steps to allow folding of thick metal. The hydraulic cylinder preferably includes an adjustment screw for adjusting of the maximum stroke of the cylinder to enable the operator to conform the method of operation to the predetermined measurements of the folded seam.

In a further embodiment of the present invention the support carrying the locking wheel carriage is mounted on top of an adjustment carriage. The support roller is rotatably mounted on this adjustment carriage as well, and this particular construction simplifies the adjustment of the jointing machine as well as the moving, extendng or turning of the metal sheet or sheet segments.

Figure 2:
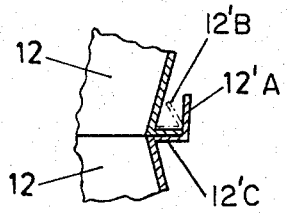
Figure 3:
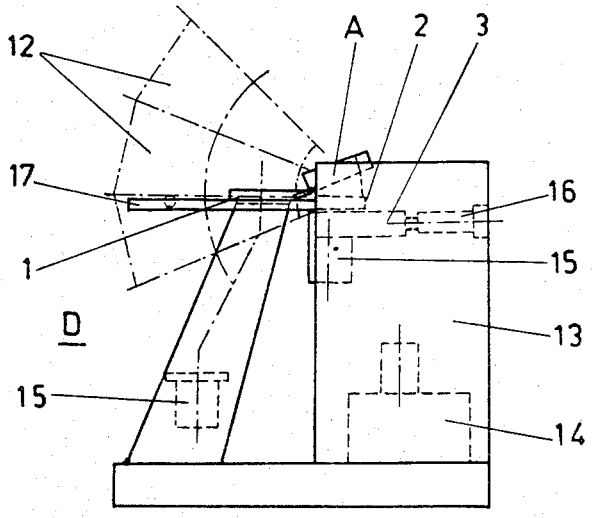

DETAILED DESCRIPTION OF THE INVENTION the present invention will be understood more readily with reference to the accompanying drawings, wherein FIG. 1 is a partial sectional view of one embodiment of the present invention illustrating the tool member of the seam folding machine;

FIG. 2 illustrates three different phases in the processing of a folded seam joining two metal sheet segments; and, FIG. 3 is a schematic view of a joint closing machine of the present invention utilizing the tool member of FIG. 1.

As illustrated in FIG. 1, tool member A includes an adjustment roller 1 (which is only partially depicted), a support roller 2 having a fixed axis of rotation, and a locking wheel 6 which is rotatably positioned in an elongated recess 18 of a locking wheel carriage 5. The locking wheel carriage 5 in turn is slidably received in a recess of a carriage support 4. The upper surface of locking wheel carriage 5 is held by means of guide plate 9. Guide plate 9 is attached to carriage support 4 by means of screws 8, and the heads of screws 8 are associated with pressure cup springs 7 in order that plate 9 can push the locking wheel carriage 5 with sufficient force into the recess of carriage support 4. As illustrated, pressure springs 7 are cup springs, but it will be readily understood that various other types of springs could be substituted therefor. Carriage support 4 is disposed on an adjustment carriage 3 on which support roller 2 is rotatably mounted.

Locking wheel carriage 5 is mechanically connected to a hydraulic cylinder 10 for adjustment of the position of locking wheel carriage 5 and locking wheel 6 mounted thereon. The maximum stroke B of hydraulic cylinder 10 can be adjusted by means of an adjustment screw 11.

FIG. 1 illustrates portions of various metal sheet segments 12 wherein the folded seams 12' joins the different metal sheet segments 12. The spacing between the folded seams 12' of the metal sheet segments 12 is shown at C.

FIG. 1 illustrates the locking wheel 6 in a position wherein a folded seam has already been manufactured. As will be readly noted in FIG. 1, the folded seam 12' rests on and is supported by surface 2' of support roller 2, while being held at the left side thereof by adjustment roller 1 and, at the same time, pressed and folded by locking wheel 6.

FIG. 2 illustrates portions of two metal sheet segments 12 having a folded seam 12', and illustrates three different phases of the closing of the folded seam 12'. Vertical position 12' *a* depicts the onset of the closing process, diagonal line 12'*b* illustrates an intermediate stage of the closing process and horizontal line 12'*c* illustrates the finished folded seam.

FIG. 3 is a total schematic view of the folded seam closing machine of the present invention, using the tool member A of FIG. 1, and the same parts are designated with the same numbers in all of the drawings. In FIG. 3 support roller 2 is mounted on adjustment carriage 3 and faces adjustment roller 1, with sheet segments 12 passing there-inbetween. The base unit D which supports tool member A is generally known and because of that is only shown and described in a simplified manner. A hydraulic control unit 14 is positiond in a base unit frame 13. The control unit 14 powers hydraulic motors 15 for actuation of the moving parts of the closing machine of the present invention. Hydraulic cylinder 16 actuates adjustment carriage 3, and mount 17 serves to support the sheets being formed on the machine of the present invention.

What is claimed is:

1. A jointing machine for manufacturing seamed metal sheets by folding seams in segmented metal sheets, said seam having a back side and a front side and said front side of said seam having a first part and a second part, said jointing machine comprising:

support roller means, rotatable about an axis perpendicular to a first place and having an outer periphery and an upper surface, for supporting at least a portion of said first part of said front side of said seam on said upper surface parallel to said first plane, said upper surface being disposed adjacent said outer periphery;

locking wheel means, rotatable about an axis perpendicular to a second plane and having an outer periphery, for applying pressure to at least a portion of said second part of said front side of said seam to fold said at least a portion of said second part of said front side of said seam onto said at least a portion of said first part of said front side of said seam;

locking wheel carriage means, movable parallel to said second plane and disposed above said support roller means, for supporting said locking wheel means for rotation about said axis perpendicular to said second plane with said outer periphery of said locking wheel means proximate said outer periphery of said support roller means, said first plane and said second plane forming an acute angle therebetween;

adjustment roller means, rotatable in a plane parallel to said first plane and having an outer periphery, for contacting the back side of said seam with said outer periphery and supporting said back side of said seam against movement in a direction parallel to said first plane, said outer periphery of said adjustment roller means being disposed proximate the outer peripheries of said support roller means and said locking wheel means.

2. The jointing machine as claimed in claim 1, further comprising carriage support means for slidingly supporting said locking wheel carriage means for movement parallel to said second plane.

3. The jointing machine as claimed in claim 2, further comprising guide plate means for contacting said locking wheel carriage means and holding said locking wheel carriage means in said carriage support means.

4. The jointing machine as claimed in claim 3, further comprising pressure spring means for yieldably pressing said guide plate means against said locking wheel carriage means.

5. The jointing machine as claimed in claim 1, wherein said acute angle is 20°–30°.

6. The jointing machine as claimed in claim 1, further comprising hydraulic adjustment means connected to said locking wheel carriage means for hydraulic adjustment of the position of said locking wheel carriage means, said hydraulic adjustment means having an adjustable maximum stroke.

7. The jointing machine as claimed in claim 6, further comprising adjustment screw means for adjusting the maximum stroke of said hydraulic adjustment means.

8. The jointing machine as claimed in claim 2, further comprising adjustment carriage means for supporting said carriage support means and for rotatably supporting said support roller means, said adjustment carraige means movable in a direction parallel to said first plane.

9. A jointing machine for manufacturing seamed metal sheets by forming foled seams in segmented metal sheets, comprising:

a base;

a first carriage movably mounted on said base, said first carriage movable in a direction parallel to a first plane;

a shaft mounted on said first carriage;

a support roller rotatably mounted on said shaft, said support roller rotatable in a plane parallel to said first plane, said support roller having an uper surface parallel to said first plane;

a support mounted upon said first carriage;

a second carriage mounted on said support for movement in a direction parallel to a second plane, said first plane and said second plane forming an acute angle therebetween;

a joint locking wheel rotatably mounted in said second carriage, said joint locking wheel rotatable in a plane parallel to said second plane, said joint locking wheel having an outer periphery; and an adjustment roller rotatably mounted on said base, said adjustment roller rotatable in a plane parallel to said first plane, said adjustment roller having a side edge;

at least a portion of said outer periphery of said joint locking wheel being disposed overlappingly above and proximate at least a portion of said upper surface of said support roller, said side edge of said adjustment roller disposed adjacent said overlapping portions of said outer periphery and said upper surface, said overlapping portions of said outer periphery and said upper surface and said side edge cooperating to clampingly support and fold a seam in the edges of two metal sheets.

* * * * *